United States Patent [19]

Dunsmoor, Jr.

[11] 4,239,593

[45] Dec. 16, 1980

[54] MULTIPLY PAPERBOARD MACHINE

[75] Inventor: Earl W. Dunsmoor, Jr., Manhattan Beach, Calif.

[73] Assignee: Container Corporation of America, Chicago, Ill.

[21] Appl. No.: 5,135

[22] Filed: Jan. 22, 1979

[51] Int. Cl.[3] ..... D21F 1/00

[52] U.S. Cl. ..... 162/303; 162/348; 162/350

[58] Field of Search ..... 162/132, 133, 298, 299, 162/303, 304, 308, 305, 348, 350

[56] References Cited

U.S. PATENT DOCUMENTS

| | | | |
|---|---|---|---|
| 2,488,700 | 11/1949 | Bidwell | 162/348 |
| 3,357,880 | 12/1963 | Curtis | 162/350 |
| 3,915,791 | 10/1975 | Langdon | 162/303 |

FOREIGN PATENT DOCUMENTS

| | | | |
|---|---|---|---|
| 1921378 | 3/1971 | Fed. Rep. of Germany | 162/303 |
| 2023520 | 12/1971 | Fed. Rep. of Germany | 162/303 |

*Primary Examiner*—Peter Chin

*Attorney, Agent, or Firm*—Richard W. Carpenter

[57] ABSTRACT

A fibrous ply forming apparatus unit or module, which can be assembled with at least one additional essentially identical fibrous ply forming apparatus to form a multiply paperboard making machine, comprising four horizontally positioned spaced-apart rolls equally spaced from a vertical plane normal to the axes of the rolls, with said rolls being a tail roll, head roll, foot roll and guide roll, parallel to each other, a fibrous ply forming endless fabric belt wound over the four rolls, a low-vacuum box beneath a run of the fabric belt extending from the tail roll to the head roll for dewatering a forming fibrous ply deposited on said fabric run, and a high-vacuum box behind a run of the fabric belt extending from the head roll to the foot roll.

A method of manufacturing multiply paperboard by consecutively forming a series of separate paper plies on individual moving fabrics, mating second formed paper ply to one side of a first formed paper ply, mating a third formed paper ply to the other side of the first formed paper ply, sequentially mating any additional consecutively formed paper plies first to the second ply and then to the third ply and continuing such alternating side mating of any additional plies to be deposited, and as the second and each subsequent ply is mated to the board being manufactured, causing water in the newly added ply to flow from it to and out of the one or more plies constituting the partially formed paperboard.

6 Claims, 5 Drawing Figures

MULTIPLY PAPERBOARD MACHINE

This invention relates to apparatus and methods for manufacturing multiply paperboard from paper making stock. More particularly, this invention is concerned with apparatus and methods of producing multiply paperboard by combining a plurality of separately formed plies as the plies and the partially produced paperboard travel in a generally downwards direction.

BACKGROUND OF THE INVENTION

Paperboard is a widely used commercial product, both as an integral part of manufactured goods such as furniture, appliances and shelter, but also in the manufacture of storage and shipping containers and cartons.

In the manufacture of paperboard, two or more webs or plies of paper stock are formed simultaneously or sequentially on a suitable fabric belt and while still wet the plies are mated, often with pressure and an applied vacuum to cause the plies to bond together. Once all of the plies are so combined, the wet multiply paperboard is generally carried by a felt blanket to a drier where the water is evaporated and from which dry paperboard emerges. The strength of the paperboard so produced will depend to a large extent upon the number of plies of which it is made, the thickness of the finished product and the nature of the fibrous paper stock from which the plies are made.

In one conventional method of producing multiply paperboard, the plies are added consecutively starting at the bottom and building up until all of the plies are laminated together. A machine used to produce paperboard in this way is generally arranged for horizontal flow of the product with the result that a long space is needed to accommodate it. In addition, as the plies are added the flow of water is usually in one direction, i.e., downwardly, as a result of gravity and an applied vacuum below the paperboard formed with the result that the fibers of each ply do not have much of an opportunity to penetrate into the ply immediately above.

German patent application No. 1,921,378 published Mar. 25, 1971 discloses a combination horizontal and vertical machine for making paperboard by building up the number of plies from the inside to the outside. The machine, however, is one which would require a large installation space, which is undesirable. Furthermore, the water from each consecutively added new ply is not caused to flow into the previously deposited plies of the partially formed paperboard but, instead, is largely removed before that could be achieved.

Chupka U.S. Pat. No. 3,471,367 discloses a vertical paperboard machine in which the plies are formed and mated, with downward travel, from the inside to the outside by alternately applying an added ply to each side. After water is removed simultaneously from both sides of the partially formed product, a vacuum is applied to the side having the new ply, so that water is not caused to flow from it through the other plies to help develop a good bond by increased fiber intermeshing at the mating ply surfaces.

SUMMARY OF THE INVENTION

The invention provides a method and apparatus for forming multiply paperboard from the inside out with multiple reversal of water flow through the plies for improved bonding. Pressure is used to adjust ply thickness and to enhance bonding and water removal. The invention employs solid or continuous surface rolls, as distinguished from vacuum rolls, and outside vacuum boxes.

Production of paperboard according to the invention can be effected in a downwardly moving, essentially vertical direction on a machine produced according to the invention using two or more fibrous ply forming apparatus modules or units provided by the invention.

It is expected that an eight-ply paperboard manufacturing machine produced according to the invention could be about twentyfive feet high and wide and have a fifteen feet machine direction. Such a machine, thus, occupies a relatively small space, thus lowering capital investment in the machine and its housing.

According to one aspect of the invention, a multiply paperboard is produced by consecutively forming a series of two or more separate paper plies on individual moving fabrics, mating the second formed paper ply to one side of a first formed paper ply and, when more than two plies are used, mating a third formed paper ply to the other side of the first formed paper ply, and then sequentially mating any additional consecutively formed paper plies first to the second ply and then to the third ply and continuing such alternating side mating of any additional plies to be deposited, and as the second and each subsequent ply is mated to the board being manufactured, causing water in the newly added ply to flow from it to and out of the one or more plies constituting the partially formed paperboard. The water is advisably caused to flow as described by a combination of applied vacuum and roll pressure. Also, the flow path of the paperboard being formed is in a substantially downwardly directed vertical path.

Practice of the described method can be effected by using a fibrous ply forming apparatus unit or module, which can be assembled with at least one additional essentially identical fibrous ply forming apparatus to form a multiply paperboard making machine. Each such unit or module will have four horizontally positioned spaced-apart rolls equally spaced from a vertical plane normal to the axes of the rolls, with said rolls being a tail roll, head roll, foot roll and guide roll, parallel to each other, a fibrous ply forming endless fabric belt wound over the four rolls, a low-vacuum box beneath a run of the fabric belt extending from the tail roll to the head roll for dewatering a forming fibrous ply deposited on said fabric run, and a high-vacuum box behind a run of the fabric belt extending from the head roll to the foot roll. Each of the rolls advisably has a solid continuous surface.

Each module can also include a headbox positioned to deposit a fibrous ply on the fabric belt run between the tail roll and the head roll. To facilitate deposition of the fibrous ply and partial water removal, the tail roll top is arranged lower than the head roll top and the fabric belt run between these two rolls is inclined.

In a particularly suitable embodiment of the module, the head roll is located substantially vertically above the foot roll. Also, the guide roll is suitably located between the foot roll and the tail roll.

The tail roll is advisably made adjustable normal to its axis to alter tension on the fabric belt and to apply a substantially constant pressure to the ply and forming paperboard, no matter what the thickness of the ply or paperboard. The tail roll is generally made adjustable parallel to the fabric belt run between the tail roll and the head roll so as to keep the belt in line with respect to the vacuum box between these two rolls. An air cylinder is desirably used to achieve the stated adjustability of the tail roll since it readily maintains a set pressure and tension on the fabric belt.

Two or more of the described units or modules can be employed, together with a fibrous ply top holding unit and a bottom or end pressure roll to form a paperboard manufacturing machine. Such a machine comprises:

A. a top fibrous ply top holding unit having:

four horizontally positioned spaced-apart rolls equally spaced from a vertical plane normal to the axes of the rolls, with said rolls being a tail roll, head roll, foot roll and guide roll, parallel to each other, a fibrous ply forming endless fabric belt wound over the four rolls, a vacuum box beneath a run of the fabric belt extending from the tail roll to the head roll, and a vacuum box behind a run of the fabric belt extending from the head roll to the foot roll;

B. at least two fibrous ply forming apparatus, with each such apparatus comprising:

four horizontally positioned spaced-apart rolls equally spaced from a vertical plane normal to the axes of the rolls, with said rolls being a tail roll, head roll, foot roll and guide roll, parallel to each other, a fibrous ply forming endless fabric belt wound over the four rolls, a low-vacuum box beneath a run of the fabric belt extending from the tail roll to the head roll for dewatering a forming fibrous ply deposited on said fabric run, a high vacuum box behind a run of the fabric belt extending from the head roll to the foot roll, and a headbox positioned to deposit a fibrous ply on the fabric belt run between the tail roll and the head roll;

C. a first fibrous ply forming apparatus being positioned to have its head roll opposite the vacuum box of the holding unit behind the run of the fabric belt extending from the head roll to the foot roll of the holding unit;

D. the foot roll of the holding unit being positioned opposite the upper portion of the high-vacuum box of the first fibrous ply forming apparatus;

E. the head roll of the second fibrous ply forming apparatus being positioned opposite the lower portion of the high-vacuum box of the first fibrous ply forming apparatus;

F. the foot roll of the first fibrous ply forming apparatus being positioned opposite the upper portion of the high-vacuum box of the second fibrous ply forming apparatus; and G. a bottom pressure roll opposite the lower portion of the high-vacuum box of the second fibrous ply forming apparatus.

A paperboard manufacturing machine according to the invention will include one of the fibrous ply forming apparatus units or modules for each ply to be built into the paperboard, and every other unit will be located, figuratively, on opposite sides of a more or less vertical line. The head roll and tail roll of each unit and the run of fabric belt supported thereby will constitute a front face or elevation which is more or less adjacent at least a portion of the front faces of the next higher and lower units.

In a more specific aspect of the invention there is provided a multiply paperboard manufacturing machine comprising:

A. a top fibrous ply holding unit having:

four horizontally positioned spaced-apart rolls equally spaced from a vertical plane normal to the axes of the rolls, with said rolls being a tail roll, head roll, foot roll and guide roll, parallel to each other, a fibrous ply forming endless fabric belt wound over the four rolls, a vacuum box beneath a run of the fabric belt extending from the tail roll to the head roll, and a high-vacuum box behind a run of the fabric belt extending from the head roll to the foot roll;

B. a plurality of fibrous ply forming apparatus, with each such apparatus comprising:

four horizontally positioned spaced-apart rolls equally spaced from a vertical plane normal to the axes of the rolls, with said rolls being a tail roll, head roll, foot roll and guide roll, parallel to each other, a fibrous ply forming endless fabric belt wound over the four rolls, a low-vacuum box beneath a run of the fabric belt extending from the tail roll to the head roll for dewatering a forming fibrous ply deposited on said fabric run, a high-vacuum box behind a front face run of the fabric belt extending from the head roll to the foot roll, said run constituting an apparatus front face, and a headbox positioned to deposit a fibrous ply on the fabric belt run between the tail roll and the head roll;

C. the plurality of fibrous ply forming apparatus being positioned in a substantially vertical arrangement with the front face of every other apparatus fronting on, and being on, the same side of a line;

D. an uppermost forming apparatus for a first fibrous ply being positioned to have its head roll opposite the vacuum box of the holding unit behind the run of the fabric belt extending from the head roll to the foot roll of the holding unit;

E. the head roll of the second and subsequent ply forming apparatus being positioned opposite the lower portion of the high-vacuum box of the next higher fibrous ply forming apparatus;

F. the foot roll of each fibrous ply forming apparatus, except the lowermost apparatus, being positioned opposite the upper portion of the high-vacuum box of the next lower fibrous ply forming apparatus; and G. a bottom pressure roll opposite the lower portion of the high-vacuum box of the lowermost fibrous ply forming apparatus.

In such a machine, it is advisable to have the bottom pressure roll support a paperboard pick-up felt belt blanket for transporting the formed paperboard for further, conventional processing, such as to a drier.

Each endless fabric belt is necessarily arranged to be movable in a direction from the tail roll to the top roll.

In a particularly useful form of machine, the axes of the head rolls and foot rolls of the holding unit and all of the fibrous ply forming apparatus are positioned to be in or close to a vertical center line.

DETAILED DESCRIPTION OF THE DRAWINGS

So far as is practical, the same or similar elements which appear in the various views of the drawings will be identified by the same number.

Figure 1:
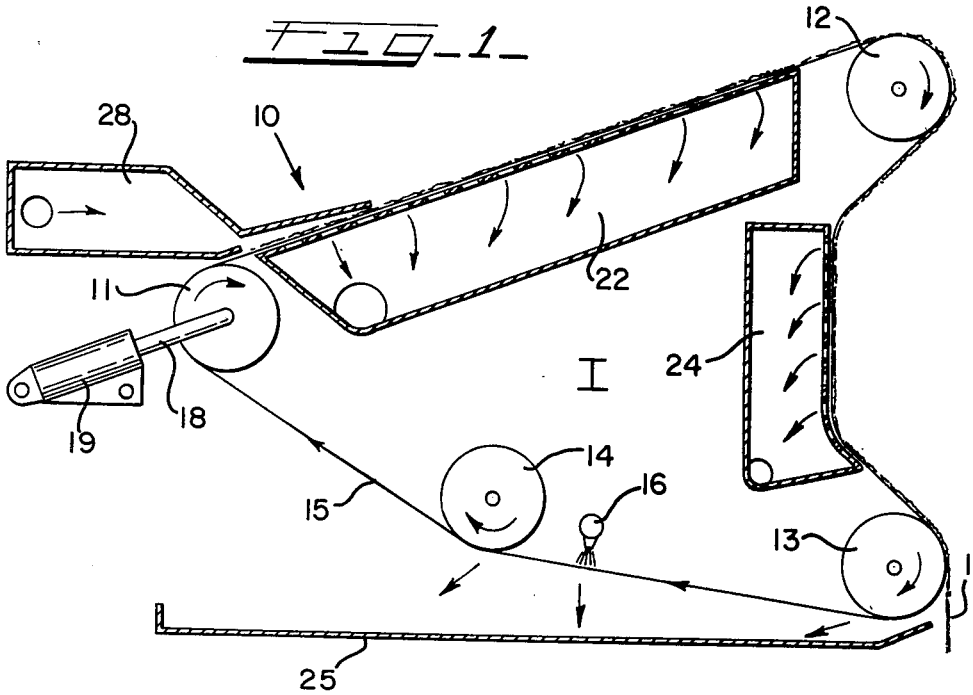
FIG. 1 is a side elevational view of a fibrous ply forming apparatus unit or module provided by the invention.

The fibrous ply forming apparatus unit or module 10 shown in FIG. 1 has a tail roll 11, a head roll 12, a foot roll 13 and a guide roll 14. Each of the four rolls has a smooth continuous uninterrupted circular and cylindrical surface. The axes of the four rolls are parallel to each other and are equally spaced from a vertical plane normal to the axes of the rolls.

Tail roll 11 is adjustably mounted so as to maintain a suitable tension on endless fabric belt 15 wound over the four rolls. Thus, tail roll 11 is joined at each end to a connecting rod 18 operably associated with a piston (not shown) in air cylinder 19. The tail roll 11 adjustment is so arranged as to be parallel with the run of belt 15 between the tail roll 11 and head roll 12. Guide roll 14 is also adjustably mounted so as to initially properly tension fabric belt 15 when it is installed on the rolls.

Positioned below the run of belt 15 between tail roll 11 and head roll 12 is a low vacuum box 22. Behind the run of belt 15 between the head roll 12 and the foot roll 13 is a high vacuum box 24. Spray device 16 is provided to wash belt 15. Beneath the entire unit 10 is located a drip pan 25 to collect water which drops from the unit during operation so that it can be properly disposed of as desired.

The fibrous ply forming apparatus can also include a fibrous stock headbox 28 from which a fibrous ply 1 is deposited on belt 15 as it moves from the tail roll 11 to the head roll 12. As the ply passes over low vacuum box 22, water is withdrawn from ply 1. A further understanding of the operation of the unit 10 will be more clearly appreciated by a description of the paperboard manufacturing machines illustrated in FIGS. 2 and 4.

The paperboard manufacturing machine 30 (FIG. 2) has a fibrous ply top holding unit 40, two fibrous ply forming apparatus 10 further identified as I and II, and a bottom pressure roll 50. Unit II is rotated 180° about a vertical axis from I so that the belt on each unit rotates in an opposite direction with respect to the other belt.

The fibrous ply top holding unit 40 has a tail roll 41, a head roll 42, a foot roll 43 and a guide roll 44. Each of the rolls has a smooth continuous surface. Tail roll 41 is advisably adjustably mounted in the same way as tail roll 11, and guide roll 44 is adjustably mounted similar to guide roll 14.

The top holding unit 40 has an endless belt 45 mounted on the rolls 41, 42, 43 and 44. This belt rotates in a direction opposite to the belt on unit I. A vacuum box 46 is located below the belt run extending from tail roll 41 to head roll 42 to dry the belt 45 after it is spray washed with water from spray 47. Located behind the run of belt from head roll 42 to foot roll 43 is a high vacuum box 48 which is located as to be opposite the head roll 12 of unit I. A drip pan 48 is positioned below the unit.

From the above it will be seen that the top holding unit 40 is very similar to the ply forming unit 10 with the main apparatus difference being that the vacuum boxes 46 and 48 are smaller than those used in the unit 10. Top holding unit 40, however, is not used to form a ply, and no headbox 28 is associated with it, so that it clearly has a different function. The function of the top holding unit 40 is to apply pressure to ply 1 formed on unit I and to dewater the ply by means of vacuum box 48.

Figure 2:
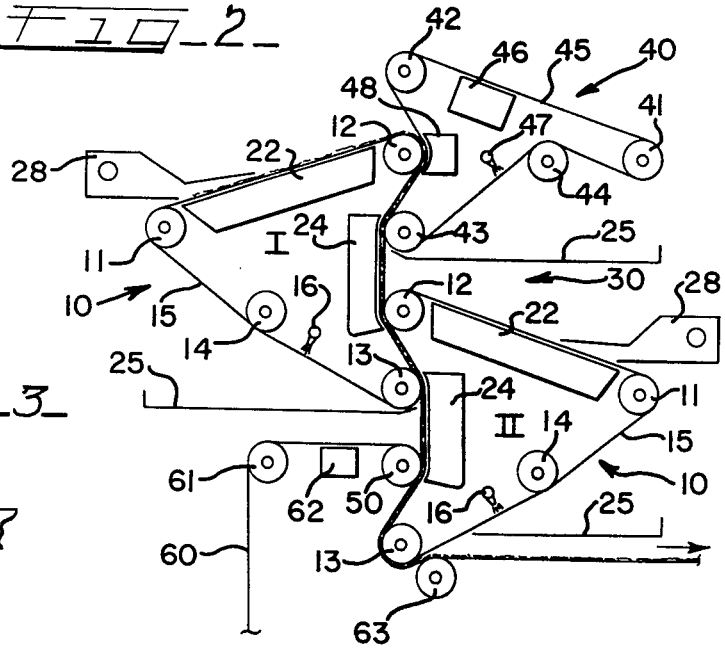
FIG. 2 is a side elevation view of a paperboard manufacturing machine, using two of the units illustrated by FIG. 1, a fibrous ply top holding unit, and a bottom pressure roll.

After a ply 1 is deposited on belt 15 of unit I in FIG. 2, it is carried by the belt between head roll 12 of unit I and belt 45 of top holding unit 40. This causes pressure to be applied to ply 1 and the pressure plus the vacuum box 48 cause the water in ply 1 to move to the right. When ply 1 is carried by belts 15 and 45 between foot roll 43 of top holding unit 40 and vacuum box 24 of unit I, the water is caused to move to the left. Equally important, the vacuum box 24 assures that the ply transfers to the fabric that is continuing instead of following the fabric which is pulling away. This important feature carries through all of the embodiments of the invention.

Ply 2 is formed by depositing fibrous material on belt 15 of unit II (FIG. 2). After being partially dewatered by low-vacuum box 22, the belt carries the ply over head roll 12 into pressure contact with the ply on the belt of unit I. Movement around roll 12 of unit II causes slight variations in the relative movement of the plies, thus mechanically aiding the ply-bond. The pressure, plus the high vacuum in box 24 of unit I causes the water in the now mated plies 1 and 2 to flow to the left. As the so-mated plies move downwardly they pass between foot roll 13 of unit I and belt 15 of unit II. The resulting pressure and the high vacuum in box 24 now cause the water in the mated two plies to flow to the right, and the two plies to disengage from the fabric on unit I and to follow the fabric on unit II.

Figure 3:
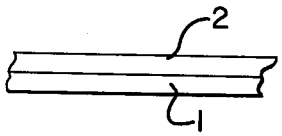
FIG. 3 is a side view of a two-ply paperboard which can be manufactured using the machine illustrated in FIG. 2.

A felt blanket 60 rolls over carrier roll 61 (FIG. 2), vacuum box 62 and then over bottom pressure roll 50. The two ply formed paperboard is pressed between bottom pressure roll 50 and the lower portion of high-vacuum box 24 causing water to flow to the right. The two-ply paperboard (FIG. 3) is carried between felt 60 and belt 15 of unit II over support roll 63 at which location the paperboard is removed from belt 15 and supported entirely by felt 60. The paperboard is then further handled according to conventional procedures to complete the paperboard manufacturing process.

The paperboard manufacturing machine of FIG. 2 will be seen to have the top holding unit 40 and the two fibrous ply forming apparatus units 10, identified as I and II, vertically arranged. Specifically, it will be noted that all of the head rolls 42 and 12, and foot rolls 43 and 13, have their axes in a vertical line.

Figure 4:
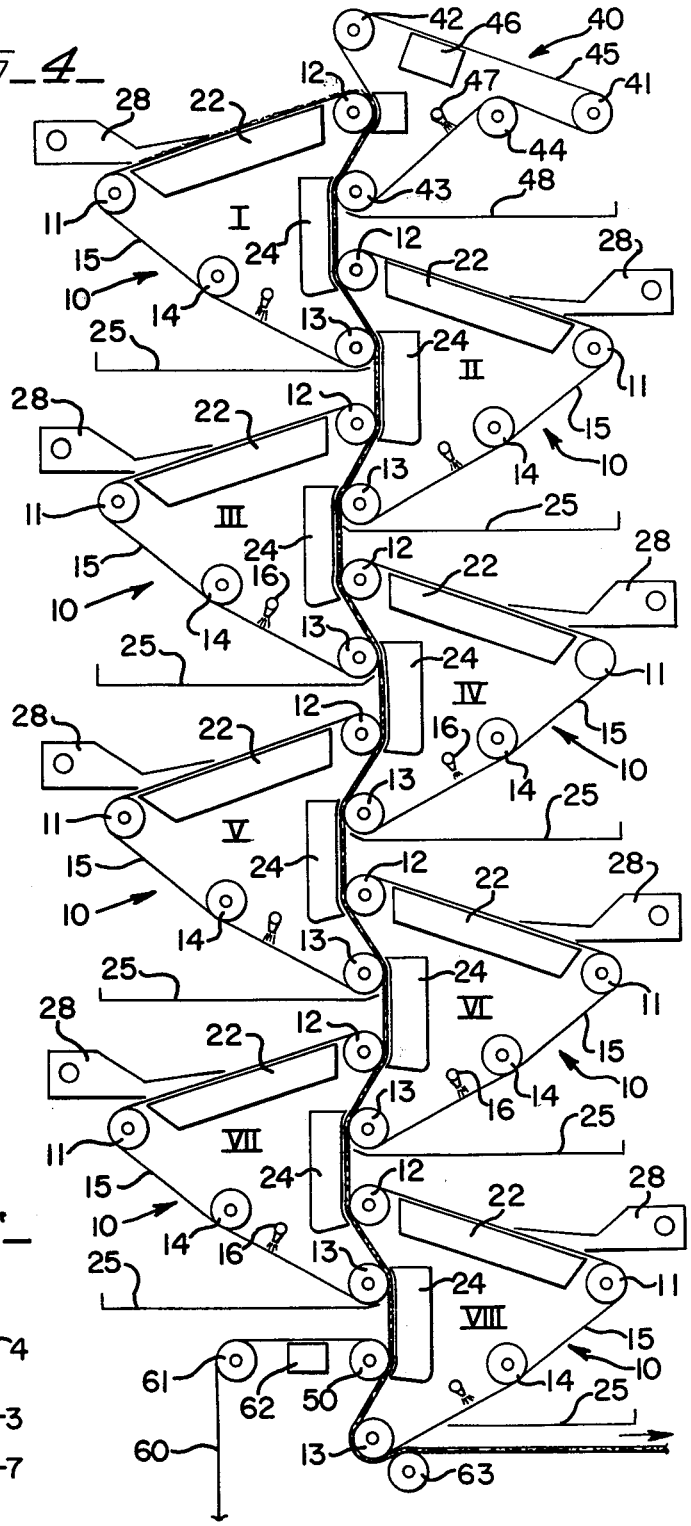
FIG. 4 is a side elevational view of a paperboard manufacturing machine, using eight of the units illustrated by FIG. 1, a fibrous ply top holding unit, and a bottom pressure roll.

FIG. 4 illustrates a further embodiment of paperboard manufacturing machine which is readily produced from the basic machine illustrated by FIG. 2 by incorporating an additional fibrous ply forming apparatus 10 into the machine for each additional ply it is desired to add to the two-ply paperboard formed with the machine of FIG. 2, it being understood that the pressure roll 50 and associated rolls 61 and 63 supporting felt 60 would be placed at the bottom of the lowermost unit 10. For a three-ply paperboard, only unit III would be added after unit II and, of course, reversing the direction in which felt 60 moves to complete the machine.

Figure 5:
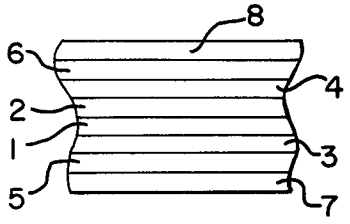
FIG. 5 is a side view of an eight-ply paperboard which can be manufactured using the machine illustrated by FIG. 4.

The specific machine shown in FIG. 4 is for the production of an eight-ply paperboard built from the inside out as shown in FIG. 5. Each of the units I to VIII is an identical unit 10 with the even numbered units II, IV, VI and VIII rotated 180° about a vertical axis to put their front faces opposite portions of the front faces of odd numbered units I, III, V and VII. Each pair of adjacent units II and III, III and IV, IV and V and so on in FIG. 4 are so positioned with respect to each other as to function in the same way as the units I and II described in conjunction with FIG. 2. Furthermore, all of the head rolls and foot rolls of the units I to VIII, and of the top unit 40, have their axes positioned in a vertical line. Furthermore, the plies of the paperboard shown in FIG. 5 produced by the machine of FIG. 4 from the inside out. Unit I forms ply 1, unit II forms ply 2, unit III forms ply 3, unit IV forms ply 4 and so on.

It will be readily seen and appreciated that in a machine as illustrated by FIG. 4, the flow of water through the paperboard being formed reversed direction nine times thereby greatly increasing interconnection of fibers at the ply boundaries with improved bonding and production of a strong multiply paperboard.

The amount of vacuum in low vacuum box 22 and in high vacuum box 24 will vary according to the fibrous material used to make the paperboard. For recycled material, a vacuum of 1 to 10 inches of water would be suitable for the low vacuum box and a vacuum of 15 to 24 inches of mercury for the high vacuum box is considered acceptable. However, other values may be more suitable if the fibrous matter is rayon or another synthetic fiber.

The foregoing detailed description has been given for clearness of understanding only, and no unnecessary limitations should be understood therefrom as modifications will be obvious to those skilled in the art.

What is claimed is:

1. A multiply paperboard manufacturing machine comprising:

A. a top fibrous ply holding and wet pressing unit having:

four horizontally positioned spaced-apart rolls equally spaced from a vertical plane normal to the axes of the rolls, with said rolls being a tail roll, head roll, foot roll and guide roll, parallel to each other, a fibrous ply forming endless fabric belt wound over the four rolls, the run of fabric belt between the head roll and the tail roll being inclined, a vacuum box beneath a run of the fabric belt extending from the tail roll to the head roll, and a high vacuum box behind a run of the fabric belt extending from the head roll to the foot roll;

B. a plurality of fibrous ply forming apparatus, with each such apparatus comprising:

four horizontally positioned spaced-apart rolls equally spaced from a vertical plane normal to the axes of the rolls, with said rolls being a tail roll, head roll, foot roll and guide roll, parallel to each other, a fibrous ply forming endless fabric belt wound over the four rolls, the run of fabric between the head roll and the tail roll being inclined, a low-vacuum box beneath a run of the fabric belt extending from the tail roll to the head roll for dewatering a forming fibrous ply deposited on said fabric run, a high-vacuum box behind a front face run of the fabric belt extending vertically from the head roll to the foot roll, said run constituting an apparatus front face, and a headbox positioned to deposit a fibrous ply on the fabric belt run between the tail roll and the head roll;

the plurality of fibrous ply forming apparatus being positioned in a substantially vertical arrangement with the front face of every other apparatus fronting on, and being on, the same side of a vertical line;

the vertically an uppermost forming apparatus for a first fibrous ply being positioned to have its head roll opposite and close to the vacuum box of the holding unit behind the run of the fabric belt extending from the head roll to the foot roll of the holding unit;

the head roll of the second and subsequent ply forming apparatus being positioned opposite and close to the lower portion of the high-vacuum box of the next higher fibrous ply forming apparatus;

the foot roll of each fibrous ply forming apparatus, except the lowermost apparatus, being positioned opposite and close to the upper portion of the high-vacuum box of the next lower fibrous ply forming apparatus; and C. a bottom pressure roll opposite and close to the lower portion of the high-vacuum box of the lowermost fibrous ply forming apparatus.

2. A machine according to claim 1 in which the bottom pressure roll supports a paperboard pick-up felt belt blanket.

3. A machine according to claim 1 in which each endless fabric belt is movable in a direction from the tail roll to the top roll of each apparatus and the holding unit.

4. A machine according to claim 3 in which the axes of the head rolls and foot rolls of the holding unit and all of the fibrous ply forming apparatus are positioned to be in or close to a vertical center line.

5. A machine according to claim 3 in which, in at least one fibrous ply forming apparatus, the tail roll is adjustable parallel to the fabric belt run between the tail roll and the head roll.

6. A machine according to claim 3 in which, in at least most of the fibrous ply forming apparatus, each of the rolls has a solid continuous surface.

* * * * *